US010233927B2

(12) United States Patent
Wang et al.

(10) Patent No.: US 10,233,927 B2
(45) Date of Patent: Mar. 19, 2019

(54) SCROLL COMPRESSOR COUNTERWEIGHT WITH AXIALLY DISTRIBUTED MASS

(75) Inventors: Xianghong Wang, Syracuse, NY (US); Kenneth D. Heusler, Palmyra, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 1121 days.

(21) Appl. No.: 13/428,072

(22) Filed: Mar. 23, 2012

(65) Prior Publication Data

US 2013/0251567 A1 Sep. 26, 2013

(51) Int. Cl.

| | |
|---|---|
| ***F04C 18/02*** | (2006.01) |
| ***F04C 29/12*** | (2006.01) |
| ***F04C 23/00*** | (2006.01) |
| ***F04C 29/02*** | (2006.01) |

(52) U.S. Cl.

CPC ..... *F04C 18/0215* (2013.01); *F04C 23/008* (2013.01); *F04C 29/023* (2013.01); *F04C 29/126* (2013.01); *F04C 2240/60* (2013.01); *F04C 2240/807* (2013.01)

(58) Field of Classification Search

USPC ..... 418/1, 55.1, 55.5, 55.6

See application file for complete search history.

(56) References Cited

U.S. PATENT DOCUMENTS 352,216 A 5/1862 Carton
3,211,365 A * 10/1965 Phelps ..... 417/319
4,545,747 A * 10/1985 Tamura ..... F04C 18/0215 418/55.1
4,898,520 A * 2/1990 Nieter et al. ..... 418/1
5,040,958 A 8/1991 Arata et al.
5,137,437 A * 8/1992 Machida et al. ..... 418/55.1
(Continued)

FOREIGN PATENT DOCUMENTS

JP 3261392 B2 2/2002
JP 2002235680 A 8/2002
JP 2011149383 A 8/2011

OTHER PUBLICATIONS

U.S. Appl. No. 13/427,984, Cullen et al., filed Mar. 23, 2012.
(Continued)

*Primary Examiner* — Mark Laurenzi
*Assistant Examiner* — Paul Thiede
(74) *Attorney, Agent, or Firm* — Reinhart Boerner Van Deuren P.C.

(57) ABSTRACT

A scroll compressor includes first and second scroll bodies having respective bases and respective scroll ribs that project from the respective bases such that the scroll ribs mutually engage. The second scroll body is movable relative to the first scroll body for compressing fluid. A drive shaft has a longitudinal axis and an eccentric drive pin configured to engage a drive hub on the second scroll body. A counterweight has a hub portion, and a perimeter portion positioned radially outward from the hub portion. A radial axis divides the counterweight into a first and second regions. The mass of the hub portion in the first region being roughly equal to the mass of the hub portion in the second region, and the mass in the perimeter portion being distributed between the first and second regions such that the center of mass of the counterweight is located along the radial axis.

10 Claims, 11 Drawing Sheets

(56) References Cited

U.S. PATENT DOCUMENTS

| | | | | |
|---|---|---|---|---|
| 5,247,736 | A * | 9/1993 | Fraser et al. | 29/888.022 |
| 5,290,161 | A * | 3/1994 | Swain | 418/55.1 |
| 5,342,185 | A | 8/1994 | Anderson | |
| 5,366,360 | A | 11/1994 | Bookbinder et al. | |
| 5,370,513 | A * | 12/1994 | Fain | 418/55.6 |
| 5,407,335 | A | 4/1995 | Caillat et al. | |
| 5,427,511 | A | 6/1995 | Caillat et al. | |
| 5,482,450 | A | 1/1996 | Caillat et al. | |
| 5,580,230 | A | 12/1996 | Keifer et al. | |
| 5,897,306 | A | 4/1999 | Beck | |
| 6,174,149 | B1 * | 1/2001 | Bush | 418/55.1 |
| 6,293,767 | B1 | 9/2001 | Bass | |
| 6,398,530 | B1 | 6/2002 | Hasemann | |
| 6,560,868 | B2 | 5/2003 | Milliff et al. | |
| 6,648,616 | B2 | 11/2003 | Patel et al. | |
| 6,761,541 | B1 | 6/2004 | Clendenin | |
| 6,814,551 | B2 | 11/2004 | Kammhoff et al. | |
| 6,960,070 | B2 | 11/2005 | Kammhoff et al. | |
| 7,070,401 | B2 | 7/2006 | Clendenin et al. | |
| 7,112,046 | B2 | 9/2006 | Kammhoff et al. | |
| 7,163,383 | B2 * | 1/2007 | Skinner | 417/410.5 |
| 7,717,687 | B2 * | 5/2010 | Reinhart | 418/55.5 |
| 7,819,638 | B2 | 10/2010 | Grimm et al. | |
| 7,967,581 | B2 | 6/2011 | Beagle et al. | |
| 8,002,528 | B2 | 8/2011 | Hodapp et al. | |
| 2003/0219349 | A1 | 11/2003 | Milliff et al. | |
| 2008/0219872 | A1 | 9/2008 | Reinhart et al. | |
| 2008/0292484 | A1 * | 11/2008 | Suh et al. | 418/55.3 |
| 2009/0136372 | A1 * | 5/2009 | Elson | F04C 18/0215 418/55.1 |
| 2009/0185930 | A1 | 7/2009 | Beagle et al. | |
| 2009/0185931 | A1 * | 7/2009 | Beagle et al. | 418/55.1 |

OTHER PUBLICATIONS

U.S. Appl. No. 13/427,991, Rogalski, filed Mar. 23, 2012.
U.S. Appl. No. 13/427,992, Bessel et al., filed Mar. 23, 2012.
U.S. Appl. No. 13/428,036, Bush et al., filed Mar. 23, 2012.
U.S. Appl. No. 13/428,165, Heusler, filed Mar. 23, 2012.
U.S. Appl. No. 13/428,172, Roof et al., filed Mar. 23, 2012.
U.S. Appl. No. 13/428,173, Bush, filed Mar. 23, 2012.
U.S. Appl. No. 13/428,026, Roof, filed Mar. 23, 2012.
U.S. Appl. No. 13/428,042, Roof et al., filed Mar. 23, 2012.
U.S. Appl. No. 13/428,072, Wang et al., filed Mar. 23, 2012.
U.S. Appl. No. 13/428,337, Duppert et al., filed Mar. 23, 2012.
U.S. Appl. No. 13/428,406, Duppert, filed Mar. 23, 2012.
U.S. Appl. No. 13/428,407, Duppert et al., filed Mar. 23, 2012.
U.S. Appl. No. 13/428,505, Duppert et al., filed Mar. 23, 2012.

* cited by examiner

SCROLL COMPRESSOR COUNTERWEIGHT WITH AXIALLY DISTRIBUTED MASS

FIELD OF THE INVENTION

This invention generally relates to scroll compressors for compressing refrigerant.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors assemblies conventionally include an outer housing having a scroll compressor contained therein. A scroll compressor includes first and second scroll compressor members. A first compressor member is typically arranged stationary and fixed in the outer housing. A second scroll compressor member is movable relative to the first scroll compressor member in order to compress refrigerant between respective scroll ribs which rise above the respective bases and engage in one another. Conventionally the movable scroll compressor member is driven about an orbital path about a central axis for the purposes of compressing refrigerant. An appropriate drive unit, typically an electric motor, is provided usually within the same housing to drive the movable scroll member.

Conventional scroll compressors typically use upper and lower counterweights for dynamic balance. Typically, the upper counterweight is mounted on a shaft between the main bearing, or crankcase, and a rotor. The lower counterweight may be attached at a bottom portion of the rotor. When the mass of the upper counterweight is unevenly distributed, it may cause deflection of the shaft during scroll compressor operation.

Embodiments of the invention described hereinbelow represent an advancement over the state of the art with respect to scroll compressors. These and other advantages of the invention, as well as additional inventive features, will be apparent from the description of the invention provided herein.

BRIEF SUMMARY OF THE INVENTION

In one aspect, embodiments of the invention provide a scroll compressor that includes a housing, and scroll compressor bodies disposed in the housing. The scroll bodies include a first scroll body and a second scroll body. The first and second scroll bodies have respective bases and respective scroll ribs that project from the respective bases such that the scroll ribs mutually engage. The second scroll body is movable relative to the first scroll body for compressing fluid. A drive unit is configured to rotate a drive shaft to drive the second scroll body in an orbital path. The drive shaft has a longitudinal axis and an eccentric drive pin configured to engage a drive hub on the second scroll body. A counterweight has a hub portion with an opening therein that permits the counterweight to be assembled onto the drive shaft, and a perimeter portion attached to and positioned radially outward from the hub portion. A radial axis divides the counterweight into a first region on one side of the radial axis, and into a second region on the other side of the radial axis, the mass in the first region of the hub portion being roughly equal mass of the second region of the hub portion, and the mass in the perimeter portion being distributed between the first and second regions such that the center of mass of the counterweight is located along the radial axis.

In a particular embodiment, a crankcase abuts the first region of the counterweight, and the drive unit is adjacent to the second region of the counterweight. In a further embodiment, the radial axis is orthogonal to the longitudinal axis of the drive shaft, and the drive shaft has a locating feature to fix the position of the counterweight.

In another aspect, the invention provides a method of compressing refrigerant fluid using a scroll compressor. The method includes driving a movable scroll body having a first set of spiral scroll ribs to engage a second set of spiral scroll ribs on a fixed scroll body. The relative movement of the movable and fixed scroll bodies compresses refrigerant fluid within the first and second sets of spiral scroll ribs. Driving the movable scroll body also includes using a drive shaft with an eccentrically offset drive pin. The drive shaft has a counterweight with a hub portion and perimeter portion assembled thereon. The method further includes axially distributing the mass of the counterweight such that the center of mass is on a radial axis that divides the counterweight into a first region and a second region.

In an embodiment, the method includes configuring the counterweight such that the perimeter portion is positioned radially outward from the hub portion, and axially distributing the mass of the counterweight includes adding mass only to the second region. In a further embodiment, the method includes assembling the counterweight onto the drive shaft using a locating feature on the drive shaft. Further, the radial axis axially divides the hub portion into two roughly equal parts, and axially divides the perimeter portion into two unequal parts.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
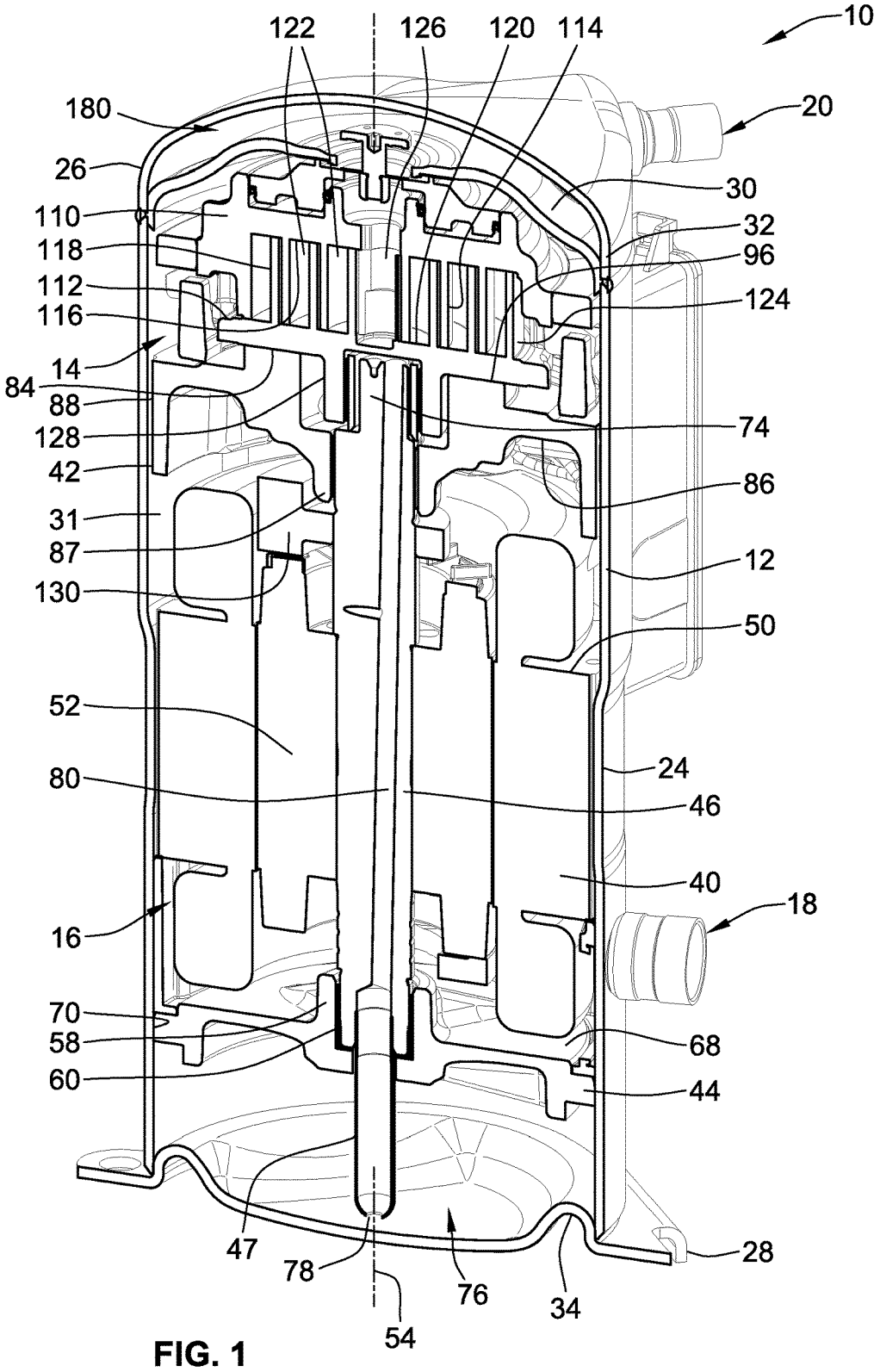
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12.

Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via a spacer, or adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearings 42, 44. Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction parallel to the central axis 54, while the terms "radial' or "radially-extending" indicates a feature that projects or extends in a direction perpendicular to the central axis 54.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

In the embodiment of FIG. 1, the drive shaft 46 has an impeller tube 47 attached at the bottom end of the drive shaft 46. In a particular embodiment, the impeller tube 47 is of a smaller diameter than the drive shaft 46, and is aligned concentrically with the central axis 54. As can be seen from FIG. 1, the drive shaft 46 and impeller tube 47 pass through an opening in the cylindrical hub 58 of the lower bearing member 44. At its upper end, the drive shaft 46 is journaled for rotation within the upper bearing member 42. Upper bearing member 42 may also be referred to as a "crankcase".

The drive shaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
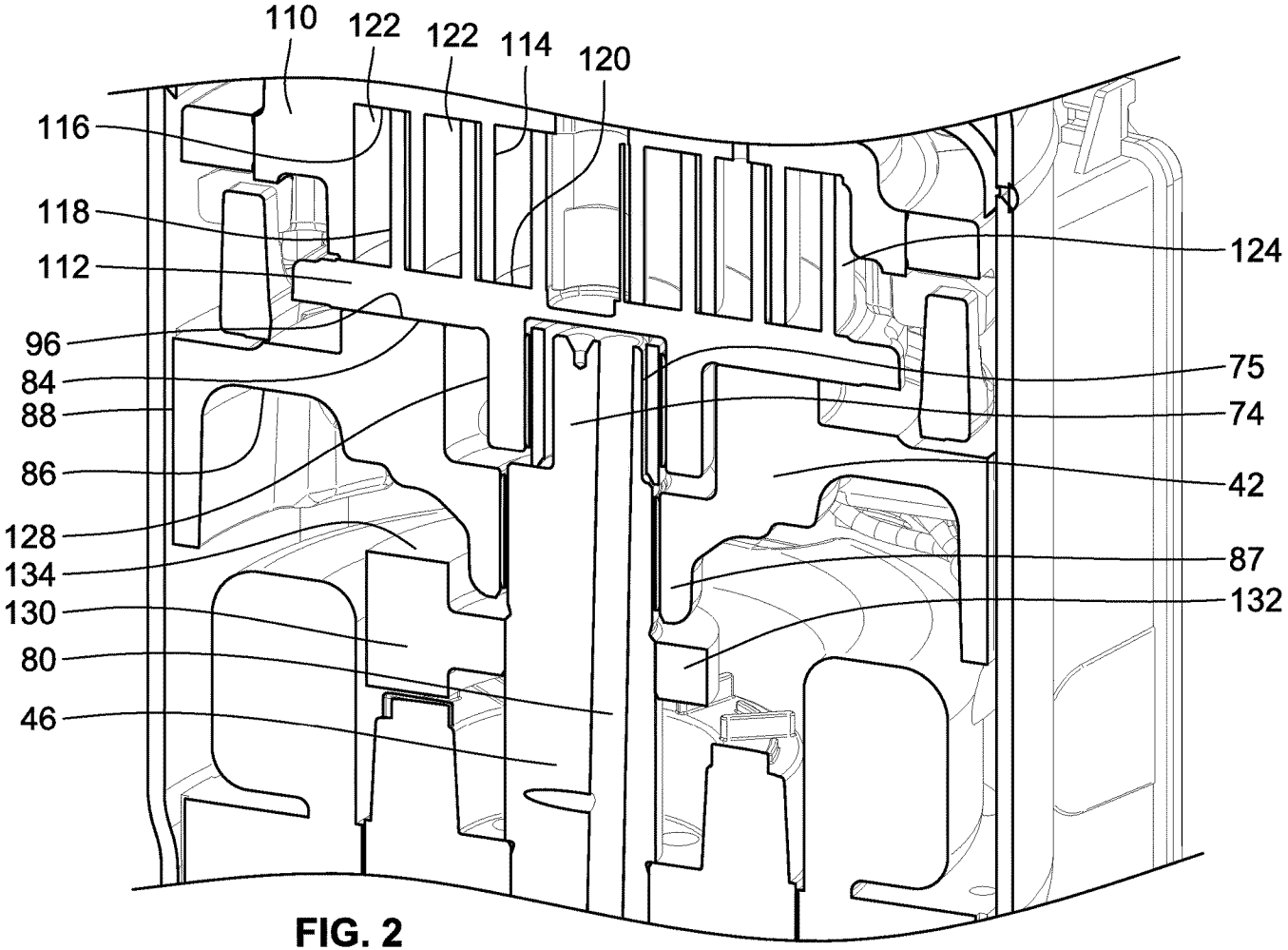
FIG. 2 is a cross-sectional isometric view of an upper portion of the scroll compressor assembly of FIG. 1.
Figure 3:
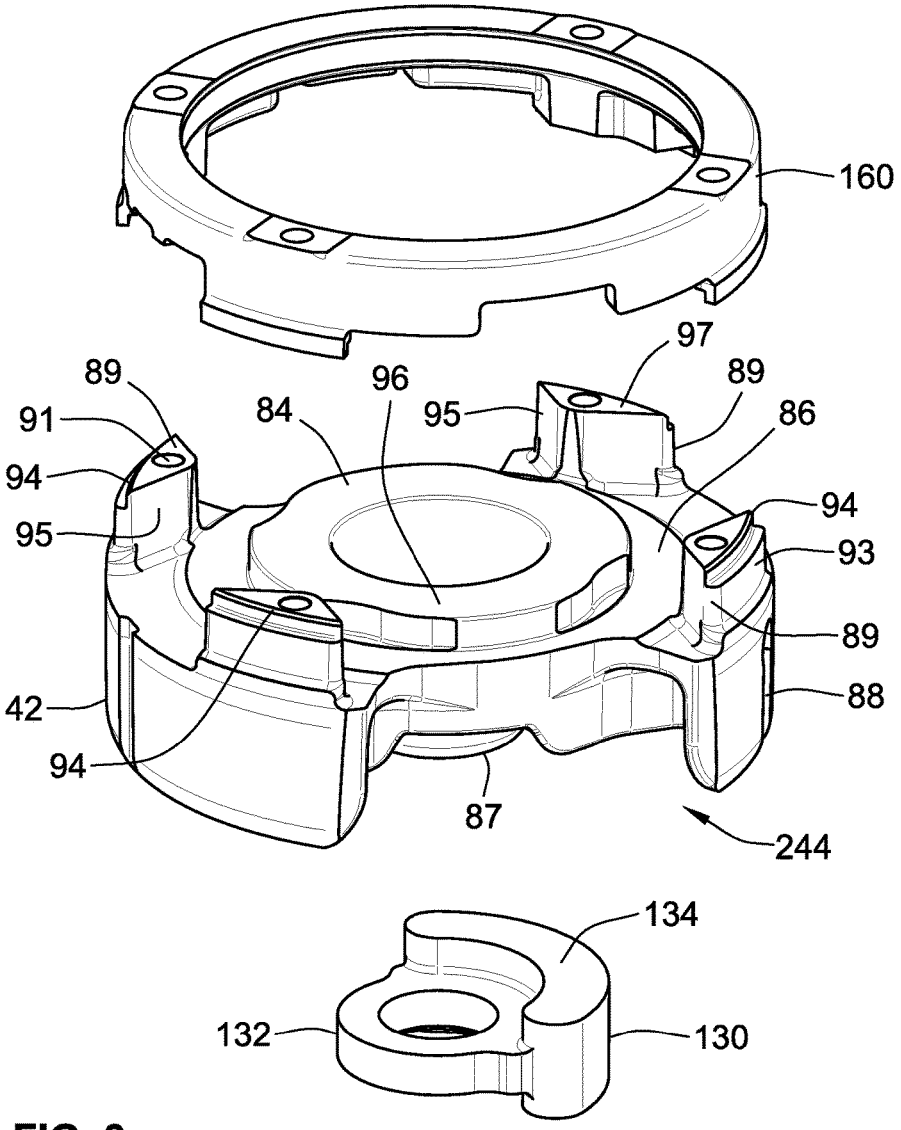
FIG. 3 is an exploded isometric view of selected components of the scroll compressor assembly of FIG. 1.

As shown in FIGS. 2 and 3, the upper bearing member, or crankcase, 42 includes a central bearing hub 87 into which the drive shaft 46 is journaled for rotation, and a thrust bearing 84 that supports the movable scroll compressor body 112. (See also FIG. 4). Extending outward from the central bearing hub 87 is a disk-like portion 86 that terminates in an intermittent perimeter support surface 88 defined by discretely spaced posts 89. In the embodiment of FIG. 3, the central bearing hub 87 extends below the disk-like portion 86, while the thrust bearing 84 extends above the disk-like portion 86. In certain embodiments, the intermittent perimeter support surface 88 is adapted to have an interference and press-fit with the outer housing 12. In the embodiment of FIG. 3, the crankcase 42 includes four posts 89, each post having an opening 91 configured to receive a threaded fastener. It is understood that alternate embodiments of the invention may include a crankcase with more or less than four posts, or the posts may be separate components altogether. Alternate embodiments of the invention also include those in which the posts are integral with the pilot ring instead of the crankcase.

In certain embodiments such as the one shown in FIG. 3, each post 89 has an arcuate outer surface 93 spaced radially inward from the inner surface of the outer housing 12, angled interior surfaces 95, and a generally flat top surface 97 which can support a pilot ring 160. In this embodiment, intermittent perimeter support surface 88 abut the inner surface of the outer housing 12. Further, each post 89 has a chamfered edge 94 on a top, outer portion of the post 89. In particular embodiments, the crankcase 42 includes a plurality of spaces 244 between adjacent posts 89. In the embodiment shown, these spaces 244 are generally concave and the portion of the crankcase 42 bounded by these spaces 244 will not contact the inner surface of the outer housing 12.

Figure 8:
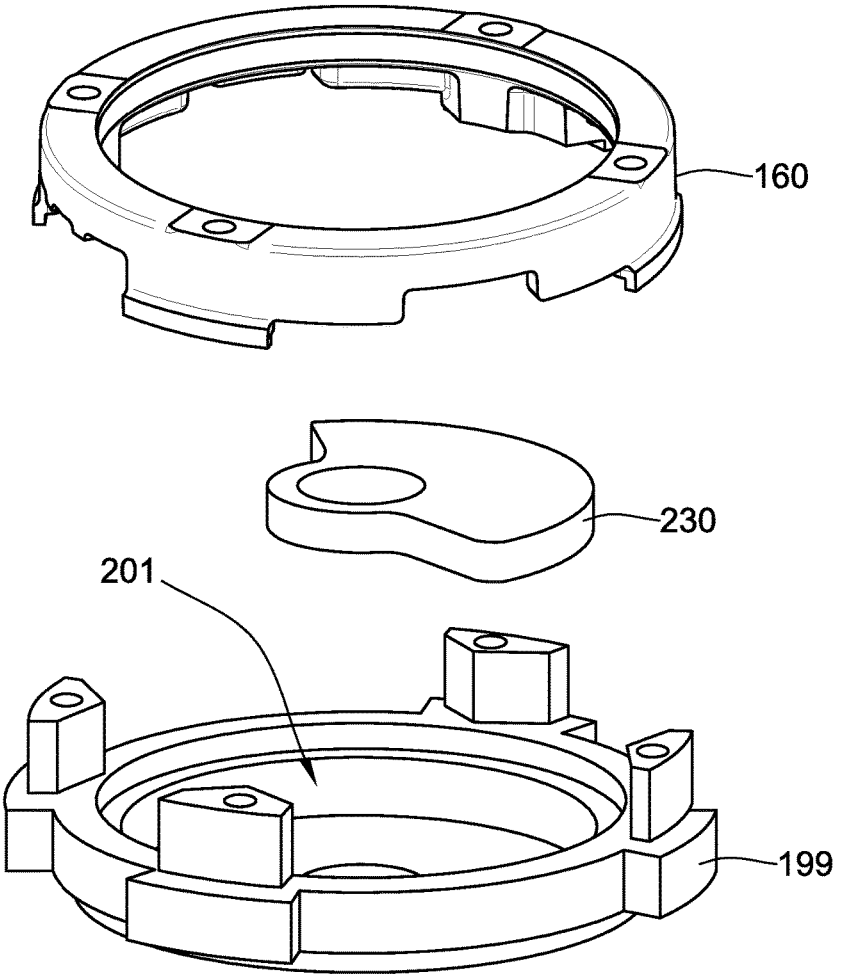
FIG. 8 is an exploded isometric view of selected components for an alternate embodiment of the scroll compressor assembly.
Figure 9:
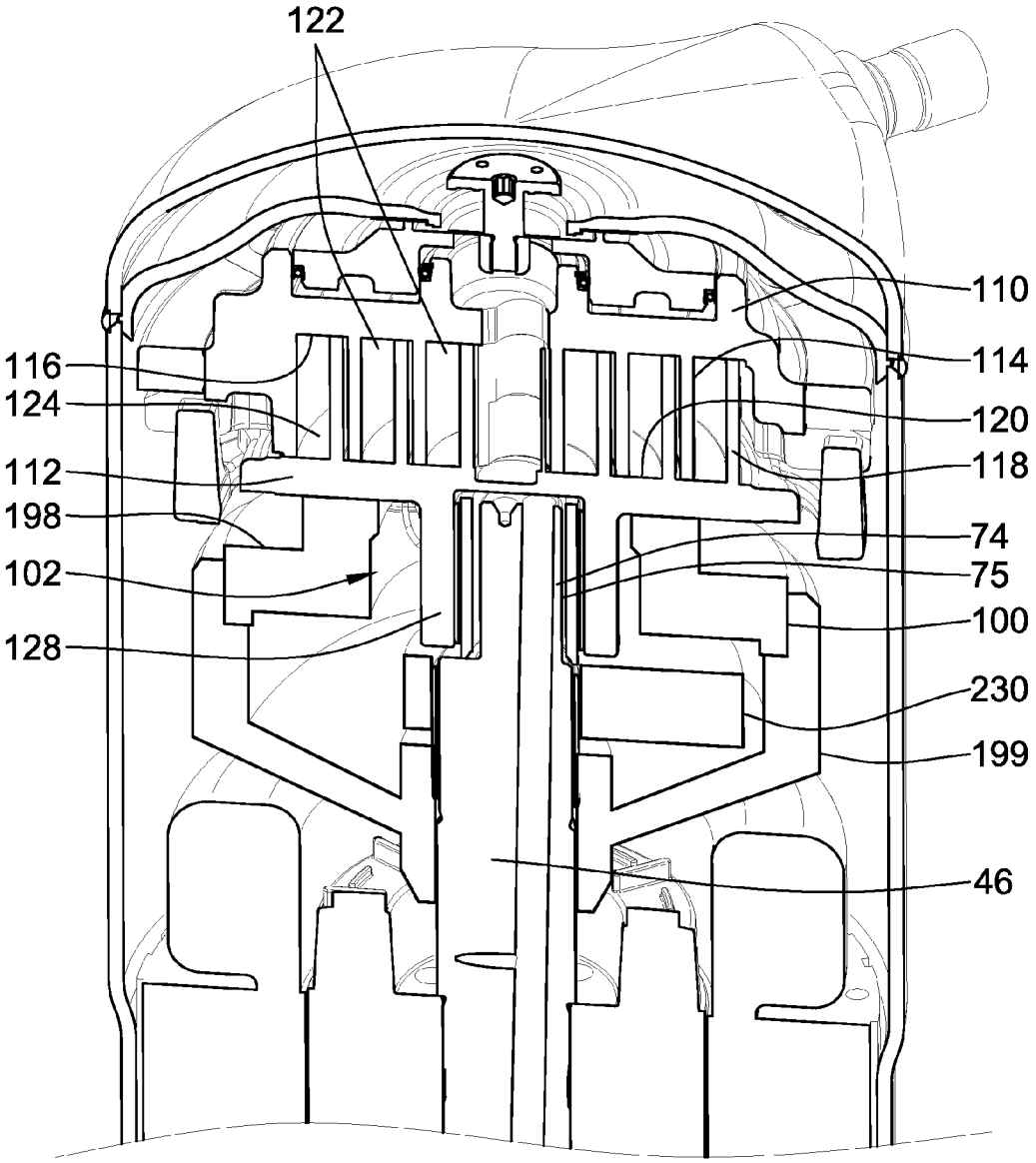
FIG. 9 is a cross-sectional isometric view of a portion of a scroll compressor assembly, constructed in accordance with an embodiment of the invention.

The upper bearing member or crankcase 42 also provides axial thrust support to the movable scroll compressor body 112 through a bearing support via an axial thrust surface 96 of the thrust bearing 84. While, as shown FIGS. 1-3, the crankcase 42 may be integrally provided by a single unitary component, FIGS. 8 and 9 show an alternate embodiment in which the axial thrust support is provided by a separate collar member 198 that is assembled and concentrically located within the upper portion of the upper bearing member 199 along stepped annular interface 100. The collar member 198 defines a central opening 102 that is a size large enough to clear a cylindrical bushing drive hub 128 of the movable scroll compressor body 112 in addition to the eccentric offset drive section 74, and allow for orbital eccentric movement thereof.

Turning in greater detail to the scroll compressor 14, the scroll compressor includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective base surfaces 120, 116 of the other respective scroll compressor body 112, 110. As a result, multiple compression chambers 122 are formed between the scroll ribs 114, 118 and the bases 120, 116 of the compressor bodies 112, 110.

Within the chambers 122, progressive compression of refrigerant takes place. Refrigerant flows with an initial low pressure via an intake area 124 surrounding the scroll ribs 114, 118 in the outer radial region (see e.g. FIGS. 1-2). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the drive shaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the drive shaft 46 about the central axis 54. Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 (see counterweight 130 shown best in FIGS. 2 and 3) that provides for the counterweight effect and thereby balancing of the overall weight of the components rotating about the central axis 54. This provides for reduced vibration and noise of the overall assembly by internally balancing or cancelling out inertial forces.

Figure 6:
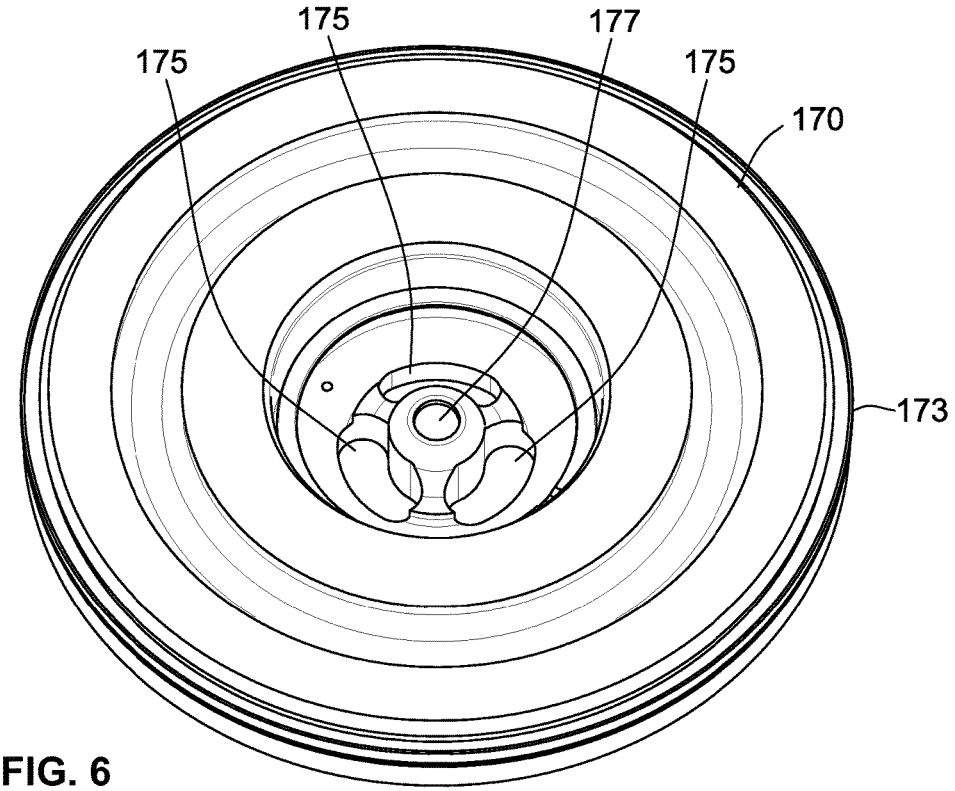
FIG. 6 is a bottom isometric view of the floating seal, according to an embodiment of the invention.
Figure 7:
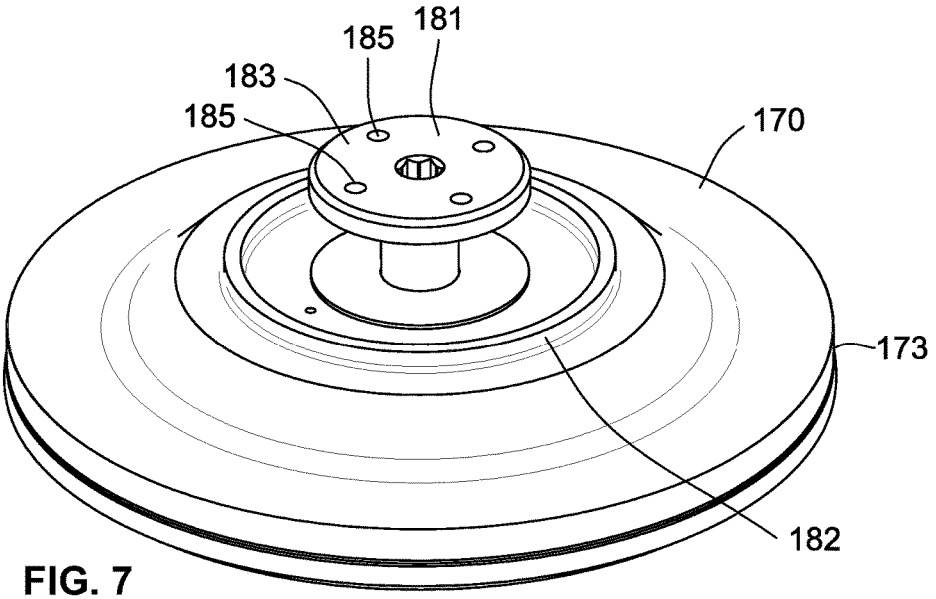
FIG. 7 is a top isometric view of the floating seal of FIG. 6.

With reference to FIGS. 4-7, the upper side (e.g. the side opposite the scroll rib) of the fixed scroll 110 supports a floating seal 170 above which is disposed the separator plate 30. In the embodiment shown, to accommodate the floating seal 170, the upper side of the fixed scroll compressor body 110 includes an annular and, more specifically, the cylindrical inner hub region 172, and the peripheral rim 174 spaced radially outward from the inner hub region 172. The inner hub region 172 and the peripheral rim 174 are connected by a radially-extending disc region 176 of the base 116. As shown in FIG. 6, the underside of the floating seal 170 has circular cutout adapted to accommodate the inner hub region 172 of the fixed scroll compressor body 110. Further, as can be seen from FIGS. 4 and 5, the perimeter wall 173 of the floating seal is adapted to fit somewhat snugly inside the peripheral rim 174. In this manner, the fixed scroll compressor body 110 centers and holds the floating seal 170 with respect to the central axis 54.

Figure 4:
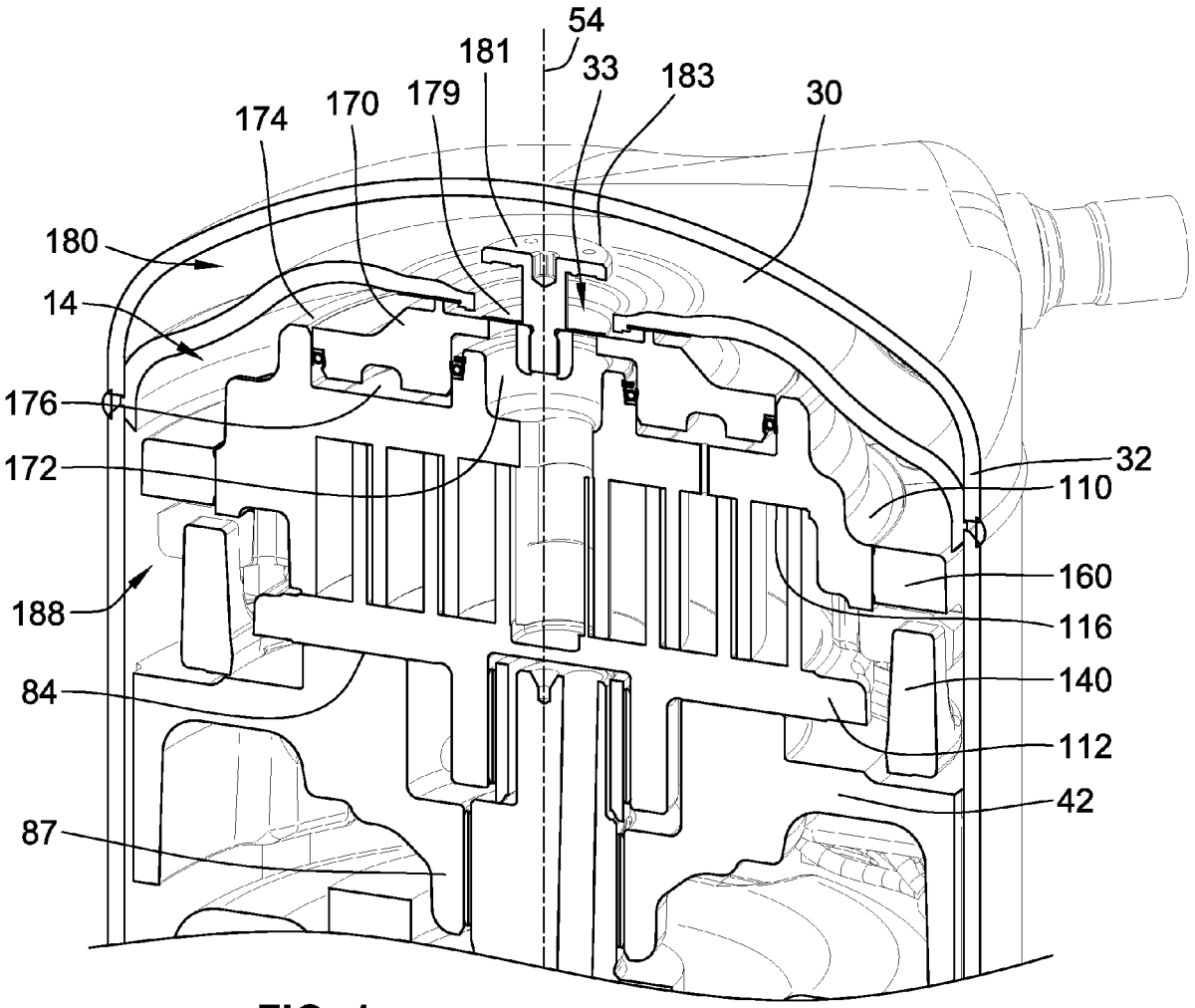
FIG. 4 is a cross-sectional isometric view of the components in the top end section of the outer housing, according to an embodiment of the invention.
Figure 5:
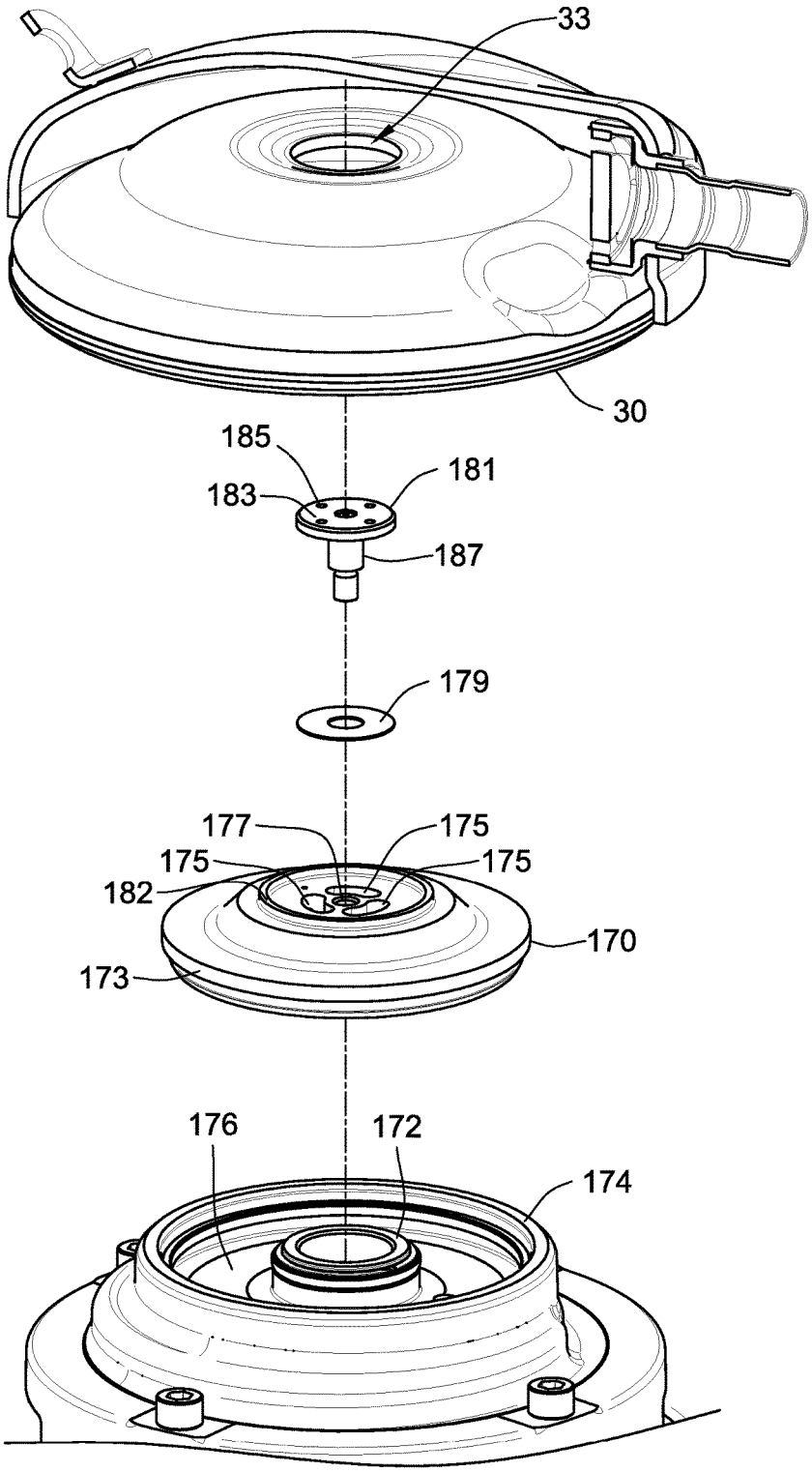
FIG. 5 is an exploded isometric view of the components of FIG. 4.

In a particular embodiment of the invention, a central region of the floating seal 170 includes a plurality of openings 175. In the embodiment shown, one of the plurality of openings 175 is centered on the central axis 54. That central opening 177 is adapted to receive a rod 181 which is affixed to the floating seal 170. As shown in FIGS. 4 through 7, a ring valve 179 is assembled to the floating seal 170 such that the ring valve 179 covers the plurality of openings 175 in the floating seal 170, except for the central opening 177 through which the rod 181 is inserted. The rod 181 includes an upper flange 183 with a plurality of openings 185 therethrough, and a stem 187. As can be seen in FIG. 4, the separator plate 30 has a center hole 33. The upper flange 183 of rod 181 is adapted to pass through the center hole 33, while the stem 187 is inserted through central opening 177. The ring valve 179 slides up and down the rod 181 as needed to prevent back flow from a high-pressure chamber 180.

With this arrangement, the combination of the separator plate 30 and the fixed scroll compressor body 110 serve to separate the high pressure chamber 180 from a lower pressure region 188 within the outer housing 12. Rod 181 guides and limits the motion of the ring valve 179. While the separator plate 30 is shown as engaging and constrained radially within the cylindrical side wall region 32 of the top end housing section 26, the separator plate 30 could alternatively be cylindrically located and axially supported by some portion or component of the scroll compressor 14.

In certain embodiments, when the floating seal 170 is installed in the space between the inner hub region 172 and the peripheral rim 174, the space beneath the floating seal 170 is pressurized by a vent hole (not shown) drilled through the fixed scroll compressor body 110 to chamber 122 (shown in FIG. 2). This pushes the floating seal 170 up against the separator plate 30 (shown in FIG. 4). A circular rib 182 presses against the underside of the separator plate 30 forming a seal between high-pressure discharge gas and low-pressure suction gas.

While the separator plate 30 could be a stamped steel component, it could also be constructed as a cast and/or machined member (and may be made from steel or aluminum) to provide the ability and structural features necessary to operate in proximity to the high-pressure refrigerant gases output by the scroll compressor 14. By casting or machining the separator plate 30 in this manner, heavy stamping of such components can be avoided.

During operation, the scroll compressor assembly 10 is operable to receive low-pressure refrigerant at the housing inlet port 18 and compress the refrigerant for delivery to the high-pressure chamber 180 where it can be output through the housing outlet port 20. This allows the low-pressure refrigerant to flow across the electrical motor assembly 40 and thereby cool and carry away from the electrical motor assembly 40 heat which can be generated by operation of the motor. Low-pressure refrigerant can then pass longitudinally through the electrical motor assembly 40, around and through void spaces therein toward the scroll compressor 14. The low-pressure refrigerant fills the chamber 31 formed between the electrical motor assembly 40 and the outer housing 12. From the chamber 31, the low-pressure refrigerant can pass through the upper bearing member or crankcase 42 through the plurality of spaces 244 that are defined by recesses around the circumference of the crankcase 42 in order to create gaps between the crankcase 42 and the outer housing 12. The plurality of spaces 244 may be angularly spaced relative to the circumference of the crankcase 42.

After passing through the plurality of spaces 244 in the crankcase 42, the low-pressure refrigerant then enters the intake area 124 between the fixed and movable scroll compressor bodies 110, 112. From the intake area 124, the low-pressure refrigerant enters between the scroll ribs 114, 118 on opposite sides (one intake on each side of the fixed scroll compressor body 110) and is progressively compressed through chambers 122 until the refrigerant reaches its maximum compressed state at the compression outlet 126 from which it subsequently passes through the floating seal 170 via the plurality of openings 175 and into the high-pressure chamber 180. From this high-pressure chamber 180, high-pressure compressed refrigerant then flows from the scroll compressor assembly 10 through the housing outlet port 20.

FIGS. 8 and 9 illustrate an alternate embodiment of the invention. Instead of a crankcase 42 formed as a single piece, FIGS. 8 and 9 show an upper bearing member or crankcase 199 combined with a separate collar member 198, which provides axial thrust support for the scroll compressor 14. In a particular embodiment, the collar member 198 is assembled into the upper portion of the upper bearing member or crankcase 199 along stepped annular interface 100. Having a separate collar member 198 allows for a counterweight 230 to be assembled within the crankcase 199, which is attached to the pilot ring 160. This allows for a more compact assembly than described in the previous embodiment where the counterweight 130 was located outside of the crankcase 42.

As is evident from the exploded view of FIG. 8 and as stated above, the pilot ring 160 can be attached to the upper bearing member or crankcase 199 via a plurality of threaded fasteners to the upper bearing member 199 in the same manner that it was attached to crankcase 42 in the previous embodiment. The flattened profile of the counterweight 230 allows for it to be nested within an interior portion 201 of the upper bearing member 199 without interfering with the collar member 198, the key coupling 140, or the movable scroll compressor body 112.

Scroll compressors using "slider block radial compliance" rely on an eccentric bearing, a slider block 150, which is separate from the eccentric drive pin 74. In particular embodiments, the slider block 150 fits over the eccentric drive pin 74 on the end of the drive shaft 46. Typically, the slider block 150 is engaged through a drive surface feature of the drive pin 74.

Figure 10:
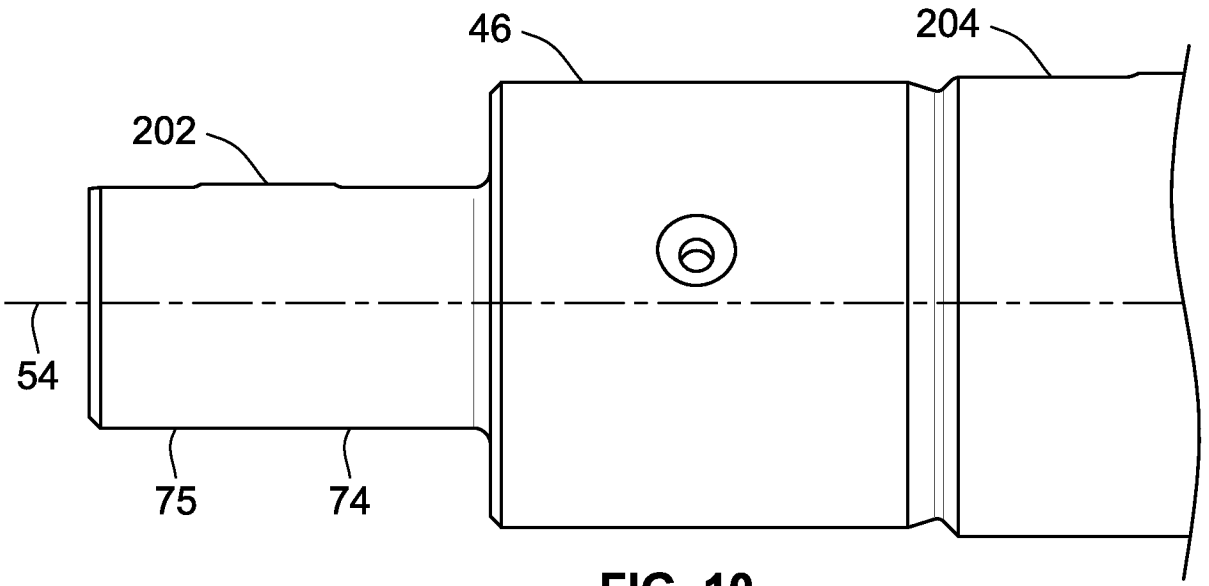
FIG. 10 is a plan view of a drive shaft, constructed in accordance with an embodiment of the invention.
Figure 11:
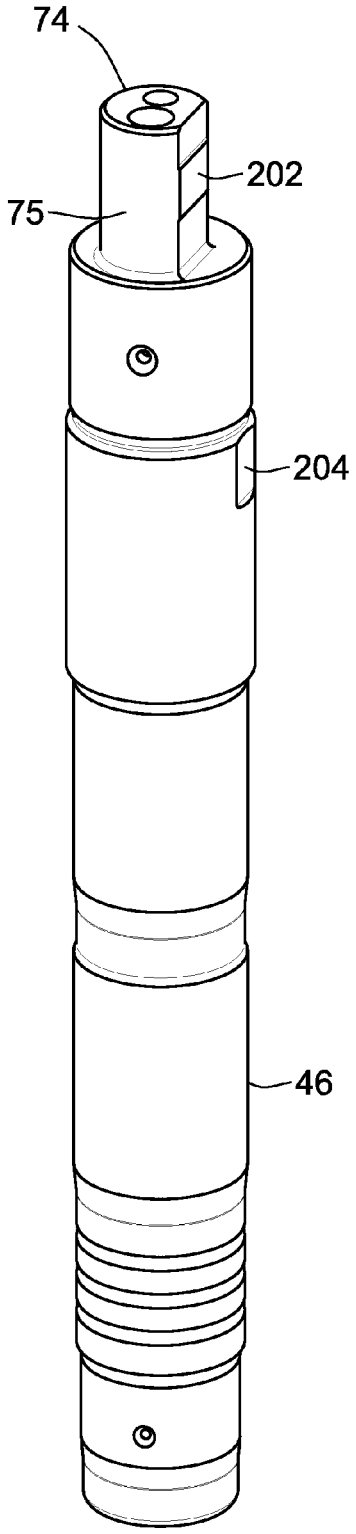
FIG. 11 is an isometric view of the drive shaft of FIG. 10.

FIGS. 10 and 11 show plan and isometric view of the drive shaft 46 constructed in accordance with an embodiment of the invention. In the particular embodiment shown, the cylindrical drive surface of the drive pin 74, has a drive surface 202 in a first plane that extends axially parallel to the central axis 54. The drive surface 202 is configured to engage a generally flat portion on the inner peripheral surface of the slider block 150. In at least one embodiment of the invention, the drive surface 202 is generally flat and rectangular. However, alternate embodiments are envisioned in which the drive surface 202 has a shape other than rectangular.

Further, in certain embodiments, the drive surface 202 may be slightly rounded. In its flat embodiment, the drive surface 202 is contained in the first plane. In its slightly rounded embodiment, the drive surface 202 includes one or more points that engage the generally flat portion on the inner peripheral surface of the slider block 150 in the first plane. Thus, whether flat or rounded, the drive surface 202 acts along the first plane. For example, in particular embodiments, the apex of a rounded drive surface 202 will engage the inner peripheral surface of the slider block 150 along one or more points in the first plane, wherein the first plane is tangential to the apex of the rounded drive surface 202.

FIGS. 10 and 11 also show the drive shaft 46 having a locating feature 204 for the counterweight 130, 230. In a particular embodiment, the locating feature 204 is located in either the first plane mentioned above, or in a second plane parallel to the first plane. In certain embodiments, the locating feature 204 is positioned in relatively close proximity to the drive surface 202 of the drive pin 74. More specifically, the locating feature 204 is axially spaced from the drive surface 202, and in a particular embodiment, the locating feature 204 is generally flat. The locating feature 204 is configured to abut a generally flat portion of an interior surface of the counterweight 130, 230. In at least one embodiment of the invention, the locating feature 204 is generally rectangular. However, alternate embodiments are envisioned in which the locating feature 204 has a shape other than rectangular.

Further, in certain embodiments, the locating feature 204 may be slightly rounded. In its flat embodiment, the locating feature 204 is contained in either the first plane or the second plane. In its slightly rounded embodiment, the locating feature 204 includes one or more points that engage the generally flat portion on the interior surface of the counterweight 130, 230. That engagement takes place either in the first plane or in the second plane. Similar to the example above, in particular embodiments, the apex of a rounded locating feature 204 will engage the interior surface of the counterweight 130, 230 along one or more points in the first or second plane, wherein the first or second plane is tangential to the apex of the rounded locating feature 204.

This engagement between the drive surface 202 and the locating feature 204 is designed to establish the proper radial orientation of the counterweight 130, 230 for balancing the rotating mass of the scroll compressor 14. The drive feature on the drive shaft 46 transmits drive forces through a similarly shaped drive feature on the interior of the slider block 150 to its exterior. The exterior of the slider block 150 acts as a common cylindrical drive bearing surface.

Both the drive surface provided by the drive surface 202 and the counterweight locating feature 204 are designed to be either coplanar or parallel to each other as shown in FIGS. 10 and 11. This simplifies the drive shaft 46 manufacturing process such that both features can be produced in a single workpiece-holding position, thereby improving the drive shaft's overall manufacturability by reducing both manufacturing cycle times and machine tolerances.

Figure 12:
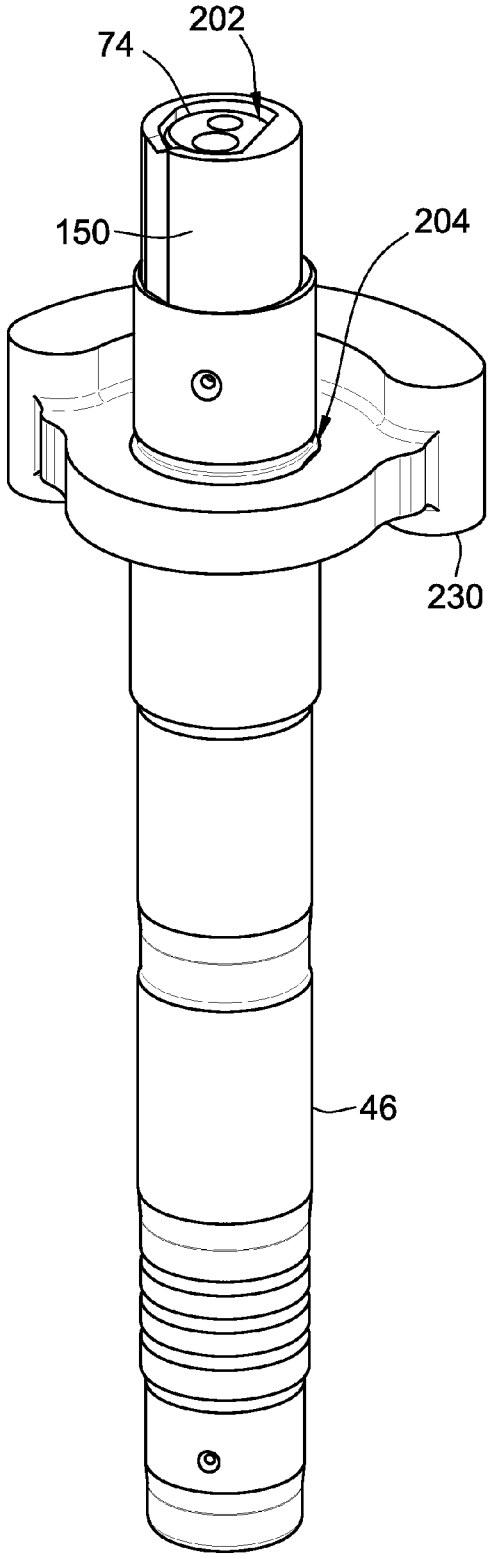
FIG. 12 is an isometric view of the drive shaft of FIG. 10 assembled with a slider block and counterweight, in accordance with an embodiment of the invention.

FIG. 12 is an isometric view of the drive shaft 46 with the slider block 150 and counterweight 230 assembled onto the drive shaft 46. The slider block 150 is located on the drive pin 74 by the drive surface 202 (see FIGS. 10 and 11). In embodiments of the invention, a plurality of generally flat portions may be used to properly locate the slider block 150. The counterweight 230 is located on the drive shaft 46 in relatively close proximity to the drive pin 74 and slider block 150. The counterweight 230 is located by the locating feature 204 (see FIGS. 10 and 11). However, in alternate embodiments, a plurality of locating features 204 may be used to properly position the counterweight 230.

Figure 13:
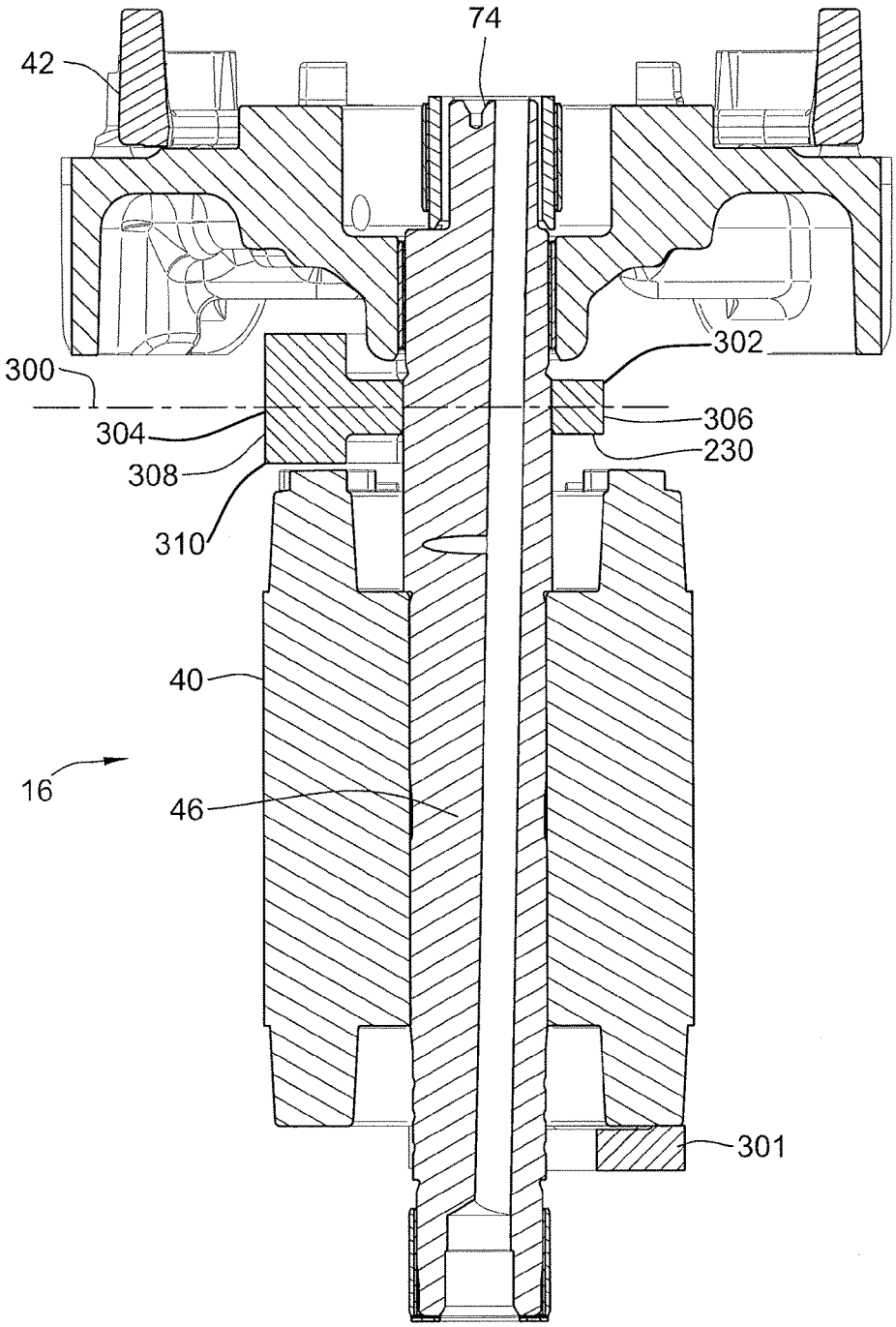
FIG. 13 is a cross-sectional view of a drive shaft with main bearing and counterweight with axially-distributed mass, in accordance with an embodiment of the invention.

FIG. 13 shows a cross-sectional view of a scroll compressor drive shaft 46, crankcase 42, and counterweight 230 with axially-distributed mass, and lower counterweight 301, constructed in accordance with an embodiment of the invention. The counterweight 230 is configured to offset a moment induced by the rotation of the movable scroll compressor body 112. The counterweight 230 is disposed in the limited space between the crankcase 42 and the drive unit electrical motor assembly 40.

While the counterweight 230 may offset the moment created by the rotation of the movable scroll body 112 (see FIG. 9) on the eccentric drive pin 74 of the drive shaft, the distribution of mass in the counterweight 230 may also create an undesirable moment that causes a deflection of the drive shaft 46 during scroll compressor operation.

In FIG. 13, the counterweight 230 is divided by a radial axis 300 that extends orthogonally to the longitudinal or central axis 54. The radial axis 300 divides the counterweight 230 into a first region 302 and a second region 304. As used heretofore and in the claims below, the term "axially" refers to a direction along the central axis 54, while the term "radially" refers to a direction along the radial axis 300.

When the mass of the counterweight 230 is unevenly distributed, as stated above, an undesirable moment is created by the counterweight 230 will deflect the drive shaft 46 during scroll compressor operation. Embodiments of the present invention include a scroll compressor with a drive shaft having a counterweight 230 assembled thereto. The mass of the counterweight 230 is distributed axially between the first and second regions such that the center of mass of the counterweight 230 is on the radial axis 300.

The counterweight 230 has a hub portion 306 and a distal or perimeter portion 308. As can be seen from FIG. 13, in particular embodiments, the radial axis 300 divides the hub portion 306 into two roughly equal axial portions—one in the first region 302 and another in the second region 304. However, radial axis 300 typically divides the perimeter portion 308 into two unequal axial portions.

In conventional scroll compressors with a radial axis corresponding to radial axis 300, a counterweight will typically have a first region, corresponding to first region 302 that is significantly larger than a second region, corresponding to second region 304. In many cases this causes an imbalance in the counterweight that results in the aforementioned undesirable moment during rotation of the counterweight, due to the counterweight center of mass being located well above the radial axis in the first region.

In the scroll compressor 14 of FIG. 13, a third region 310 has been added below the second region 304 to reduce or eliminate any imbalance in the counterweight 230. By adding the third region 310 onto the second region 304, the center of mass of the counterweight 230 is shifted from the first region 302 down to the radial axis 300 to reduce or eliminate any undesirable moment introduced by the rotating counterweight 230, thus reducing or eliminating the deflection of the drive shaft 46 by the counterweight 230.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor comprising:

a housing;

scroll compressor bodies disposed in the housing, the scroll bodies including a first scroll body and a second scroll body, the first and second scroll bodies having respective bases and respective scroll ribs that project from the respective bases, wherein the scroll ribs mutually engage, the second scroll body being movable relative to the first scroll body for compressing fluid;

a drive unit configured to rotate a drive shaft to drive the second scroll body in an orbital path, the drive shaft having a longitudinal axis and an eccentric drive pin configured to engage a drive hub on the second scroll body; and a counterweight comprising:

a hub portion with an opening therein that permits the counterweight to be assembled onto the drive shaft; and a perimeter portion attached to the hub portion, and positioned radially outward from the hub portion, the perimeter portion extending axially in a first direction farther than the hub portion extends in the first direction, and extending axially in a second direction farther than the hub portion extends in the second direction, the axial extension of the perimeter portion in the first direction being greater than the axial extension of the perimeter portion in the second direction;

wherein a radial axis in a plane that divides the hub portion and the perimeter portion of the counterweight into a first region on one side of the plane containing the radial axis and into a second region on another side of the plane containing the radial axis, the perimeter portion in the first region extending axially farther from the plane containing the radial axis in the first direction than the perimeter portion in the second region extends in the second direction;

wherein the counterweight further comprises a third portion disposed in the second region thereof, the third portion causing the mass of the counterweight to be equally distributed between the first region and the second region such that the center of mass of the counterweight is located on the radial axis.

2. The scroll compressor of claim 1, further comprising a crankcase that abuts the first region of the counterweight.

3. The scroll compressor of claim 2, wherein the drive unit is adjacent to the second region of the counterweight.

4. The scroll compressor of claim 1, wherein the radial axis and the plane are orthogonal to the longitudinal axis of the drive shaft.

5. The scroll compressor of claim 1, wherein the drive shaft has a locating feature to fix a position of the counterweight.

6. A method of manufacturing a scroll compressor, the method comprising:

providing a movable scroll body having a first set of spiral scroll ribs to engage a second set of spiral scroll ribs on a fixed scroll body, wherein the relative movement of the movable and fixed scroll bodies compresses refrigerant fluid within the first set and the second set of spiral scroll ribs, wherein providing the movable scroll body comprises providing the movable scroll body including a drive shaft disposed along a longitudinal axis and having an eccentrically offset drive pin, the drive shaft further being in communication with a counterweight having a hub portion and a perimeter portion in communication with the hub portion, the perimeter portion extending axially in a first direction farther than the hub portion extends in the first direction, and the perimeter portion extending axially in a second direction opposite the first direction farther than the hub portion extends in the second direction, the axial extension of the perimeter portion in the first direction being greater than the axial extension of the perimeter portion in the second direction, wherein a radial axis as in a plane that divides the hub portion and the perimeter portion of the counterweight into a first region on one side of the plane containing the radial axis and into a second region on another side of the plane containing the radial axis, the perimeter portion in the first region extending axially farther from the plane containing the radial axis in the first direction than the perimeter portion in the second region extends in the second direction; and axially distributing the mass of the counterweight equally between the first region and the second region such that the center of mass of the counterweight is located on the radial axis in the plane.

7. The method of claim 6, wherein the counterweight is located at a position on the drive shaft using a locating feature on the drive shaft.

8. The method of claim 6, further comprising configuring the counterweight such that the perimeter portion is positioned radially outward from the hub portion.

9. The method of claim 6, wherein the radial axis and the plane are orthogonal to the longitudinal axis of the drive shaft.

10. The method of claim 6, wherein axially distributing the mass of the counterweight comprises axially distributing the mass of the counterweight such that the counterweight includes a third portion disposed in the second region thereof, the third portion causing the mass of the counterweight to be equally distributed between the first region and the second region such that the center of mass of the counterweight is located on the radial axis.

* * * * *